United States Patent [19]

Chu et al.

[11] Patent Number: 4,682,143

[45] Date of Patent: Jul. 21, 1987

[54] THIN FILM CHROMIUM-SILICON-CARBON RESISTOR

[75] Inventors: John W. Chu, Los Altos Hills; Bradley J. Bereznak, Sunnyvale, both of Calif.

[73] Assignee: Advanced Micro Devices, Inc., Sunnyvale, Calif.

[21] Appl. No.: 792,723

[22] Filed: Oct. 30, 1985

[51] Int. Cl.[4] ..... H01C 1/012

[52] U.S. Cl. ..... 338/307; 156/601; 204/192.21; 252/503; 252/512; 338/308; 420/588; 427/102; 428/901

[58] Field of Search ..... 338/306–309; 204/192.21, 192.15; 420/588, 578; 428/901, 450; 252/503, 512, 516; 156/601, 625, 643, 646; 427/101, 102

[56] References Cited

U.S. PATENT DOCUMENTS

| | | | |
|---|---|---|---|
| 4,343,986 | 8/1982 | Mitani et al. | 338/309 |
| 4,392,992 | 7/1983 | Paulson et al. | 252/512 |
| 4,414,274 | 11/1983 | Hieber | 338/308 X |
| 4,460,494 | 7/1984 | Abe et al. | 252/512 |
| 4,517,444 | 5/1985 | Kawahito et al. | 252/512 X |
| 4,520,342 | 5/1985 | Vugts | 338/308 |
| 4,569,742 | 2/1986 | Schuetz | 338/308 X |
| 4,591,821 | 5/1986 | Paulson et al. | 338/308 |
| 4,600,658 | 7/1986 | Anderson et al. | 428/901 |

*Primary Examiner*—C. L. Albritton

*Attorney, Agent, or Firm*—Patrick T. King; John P. Taylor; J. Vincent Tortolano

[57] ABSTRACT

An improved thin film resistor material is disclosed which comprises a chromium-silicon-carbon material containing from about 25 to 35 wt. % chromium, about 45 to 55 wt. % silicon, and about 20 to 30 wt. % carbon. The resistor material is further characterized by a resistivity of greater than about 800 ohms per square to less than about 1200 ohms per square, a temperature coefficient of resistance of less than 160 ppm per degree Centigrade, and a lifetime stability of less than 0.1% change in resistivity. In the preferred embodiment, the resistor material contains 31 wt. % chromium, 46 wt. % silicon, and 24 wt. % carbon.

11 Claims, 14 Drawing Figures

THIN FILM CHROMIUM-SILICON-CARBON RESISTOR

BACKGROUND OF THE INVENTION

1. Field of the Invention

This invention relates to the production of thin film resistors. More particularly, this invention relates to thin film resistors made using special formulations of chromium, silicon, and carbon.

2. Description of the Prior Art

Thin film resistors are useful in integrated circuit structures where high sheet resistance is required. While doped polysilicon materials are conventionally used in digital circuitry, analog circuits require more precision in the resistance values including low temperature coefficients of resistance (TCR) and high stability over lifetime. A number of materials, including alloys such as nickel-chromium, have been previously used. A paper by Robert K. Waits entitled "Silicide Resistors for Integrated Circuits", published in the Proceedings of the IEEE at volume 59, No. 10 (October, 1971) at pages 1425–1429, lists a number of thin film resistor materials including a number of metal silicides, including molybdenum silicide and chromium silicide.

While the use of silicide materials for producing thin film resistors has been preferred over other materials, silicide materials are also not without problems. The same author, Robert K. Waits, describes low temperature failures of unpassivated thin film silicide resistors in "Silicon-Chromium Thin-Film Resistor Reliability" published in Thin Solid Films, volume 16 (1973) at pages 237–247.

It has been found that a material to be used in the production of thin film resistors should, ideally, possess a number of characteristics. First, the material should have a resistivity of greater than about 800 to less than about 1200 ohms per square, not only to provide a sufficiently resistive material, but to permit application, to a substrate, of a resistor film of reasonable thickness, e.g., about 100–200 Angstroms, to insure uniformity or reproducibility of the film resistivity despite slight processing differences in film thickness. The uniformity of the resistivity of the film should provide a variation in resistance at various portions of the film of not greater than about 14%.

The temperature coefficient of resistance (TCR) of such a material should be low, i.e., less than about 200 ppm per degree Centigrade over the operating temperature range, i.e., −25° to +125° C.

The resistance of the material should not substantially change during subsequent processing of the integrated circuit structure after annealing of the film, e.g., subsequent exposure to elevated temperatures under the annealing temperature. The term "substantial change", as used herein to describe changes in resistivity due to processing, is intended to define a change in resistance of not more than 0.1%.

The annealing temperature of such a resistor material should not exceed about 500° C. to avoid encountering problems with any aluminum films in the integrated circuit structure. Therefore, the resistor material must be annealable at temperatures of 500° C. or less.

The resistor material must be easily applicable to the substrate in an accurate manner since substantial variations in thickness will result in variations in the resistivity. If the material is to be applied, for example, by sputtering, the material must be responsive to reasonable gas pressures and target voltages, i.e., a pressure equal to or less than less than $2.0\times10^{-7}$ Torr and a voltage of from about 1000 to 1400 volts, preferably 1200 volts, to provide a film of uniform thickness.

Since the resistor material can be effected by the substrate, including not only the flatness of the substrate, but the mechanical stability as well, the resistor material should possess a temperature coefficient of expansion matching that of thermally grown or chemical vapor deposited (CVD) silicon oxide, including phosphorus doped oxides since these will be the normal substrate materials under the resistor film.

Finally, the resistance of the film must be stable with age. An acceptable absolute lifetime stability will result in an absolute shift of less than a 0.1% shift of the resistance over the lifetime of the structure, e.g., over a 2000 hour period at 150° C. The resistor film should also have a good matching shift stability over a lifetime as well, i.e., the degree of variation present in a resistor array. The matching shift should also be less than 0.1% over a 2000 hour period at 150° C.

SUMMARY OF THE INVENTION

It is, therefore, an object of this invention to provide an improved thin film resistor material with an acceptable resistivity, a low temperature coefficient of resistance, and good absolute and matching stability over lifetime.

It is another object of this invention to provide an improved thin film resistor material which is annealable at a temperature sufficiently above other subsequent processing temperatures utilized in constructing an integrated circuit structure containing the resistor material to avoid altering of the resistor film characteristics after annealing; yet below 500° C. to avoid problems with aluminum materials also present in the integrated circuit structure.

It is yet another object of the invention to provide an improved thin film resistor material which will have a temperature coefficient of expansion which will be compatible with that of silicon oxide substrate materials.

It is a further object of the invention to provide an improved thin film resistor material which will have both matching and absolute lifetime stability of less than 0.1% shift in resistance value.

It is yet a further object of the invention to provide an improved thin film resistor material which will have good processing characteristics including uniform response to modes of application and etching or removal of unneeded portions of the resistor films when defining specific resistors.

These and other objects of the invention will be apparent from the following description and accompanying drawings.

In accordance with the invention, an improved thin film resistor material comprises a chromium-silicon-carbon material containing from about 25 to 5 wt. % chromium, about 40 to 55 wt. % silicon, and about 20 to 30 wt. % carbon characterized by a resistivity of greater than about 800 ohms per square and less than about 1200 ohms per square, a temperature coefficient of resistance of less than 200 ppm per degree Centigrade, and lifetime absolute and matching stability of less than 0.1% change in resistivity. The resistor material should have a temperature coefficient of expansion matching that of silicon dioxide and should be annealable at a temperature below 500° C. to avoid damage to any aluminum materials already present in the structure. In the most preferred embodiment, the resistor material contains 31 wt. % chromium, 46 wt. % silicon, and 23 wt. % carbon.

DESCRIPTION OF THE PREFERRED EMBODIMENTS

The thin film chromium-silicon-carbon resistor material of the invention comprises from about 25 to 35 wt. % chromium, about 40 to 55 wt. % silicon, and about 20 to 30 wt. % carbon. In a preferred embodiment the content of the chromium-silicon-carbon resistor material comprises from about 27 to 33 wt. % chromium, from about 44 to 50 wt. % silicon, and from about 21 to 26 wt. % carbon. More preferably, the content of the chromium-silicon-carbon resistor material comprises from about 28 to 31 wt. % chromium, from about 46 to 48 wt. % silicon, and from about 23 to 24 wt. % carbon. Most preferably, the content of the chromium-silicon-carbon resistor material comprises about 31 wt. % chromium, about 46 wt. % silicon, and about 23 wt. % carbon.

Figure 3:
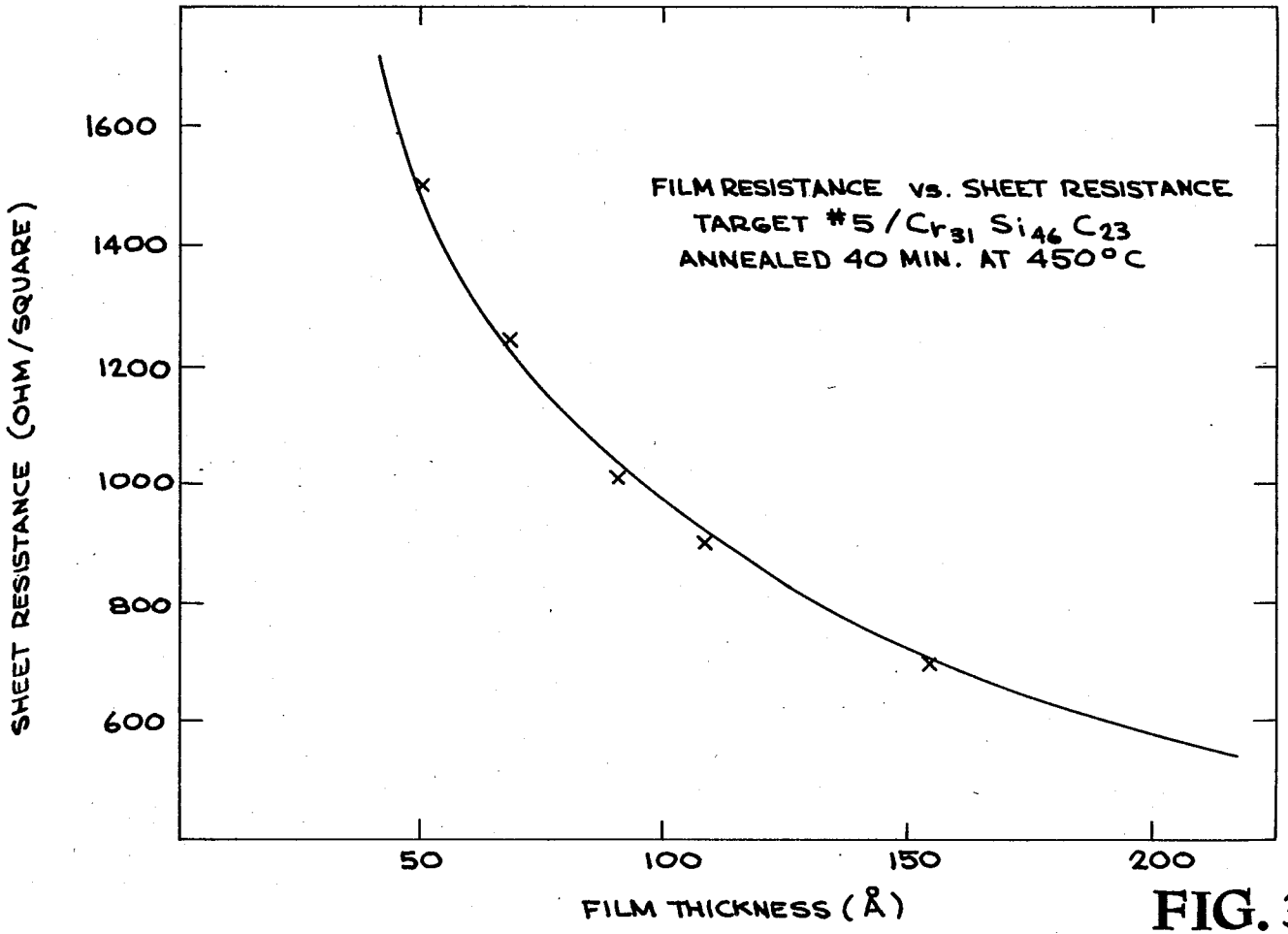
FIG. 3 is a graph plotting the resistivity against film thickness.

The resistor material of the invention may be applied to a substrate in any convenient manner which will not interfere with the performance of either the resistor film or other materials already on the substrate or subsequently applied thereto. Preferably, the resistor material is sputtered onto the substrate target to a thickness of from about 100 to 200 Angstroms. FIG. 3 illustrates the resistivity of the material as a function of film thickness. The target bias should be at about 1000–1400 volts, preferably about 1200 volts (250 Watts) with the substrate at 0 volts and a base pressure equal to or less than $2.0\times10^{-7}$ Torr. The sputtering is carried out under an inert atmosphere such as, for example, an Argon atmosphere of about 14 psi with the substrate about 20 cm. from the target.

The substrate may comprise any insulating material, but preferably comprises a silicon oxide material such as a CVD silicon oxide, which may be a phosphorus doped glass, or a thermally grown silicon oxide because of the relative matching of the temperature coefficients of expansion between such silicon oxide materials and the resistor material of the invention. Use of such materials as the underlying substrate will insure a more thermally stable result from a mechanical standpoint.

The form of the resistor material used in the sputtering may comprise a single solid material or a powder mixture which has been pressed into the form of a compact. When used in powdered form, the material may comprise a mixture of chromium-silicon and silicon carbide provided the ratios of the atomic weights of the materials are sufficient to provide the desired resistor composition on the substrate.

Figure 4A:
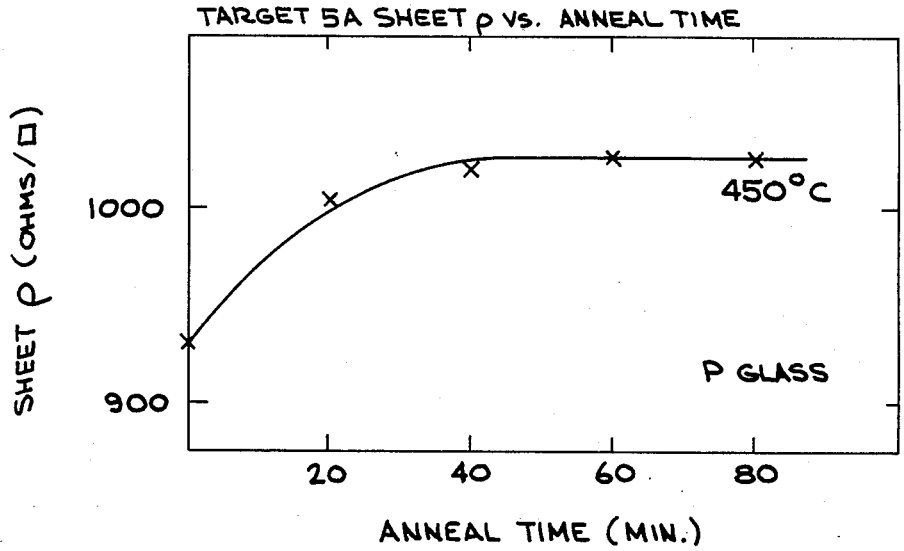
FIGS. 4A and 4B are graphs plotting the resistivity of the resistor material against anneal time at 450° C. for two different substrates.
Figure 4B:
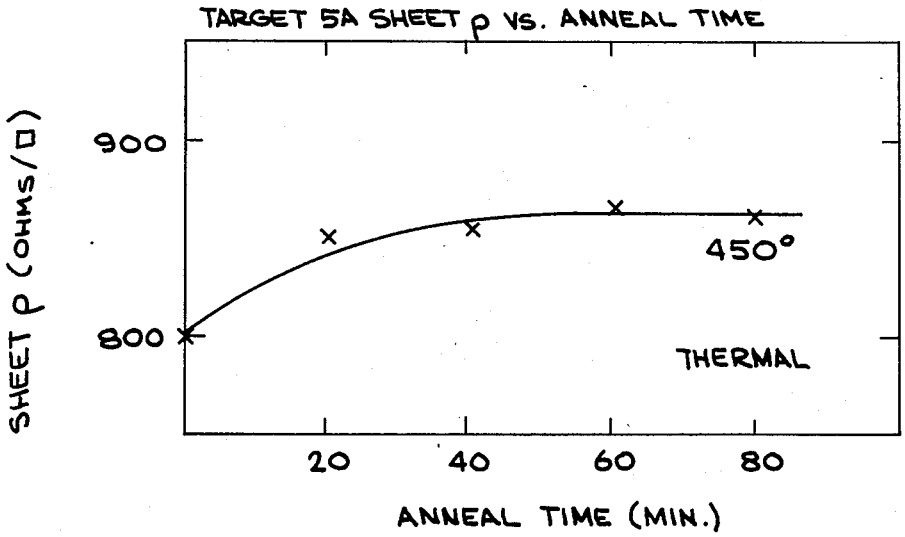
Figure 6:
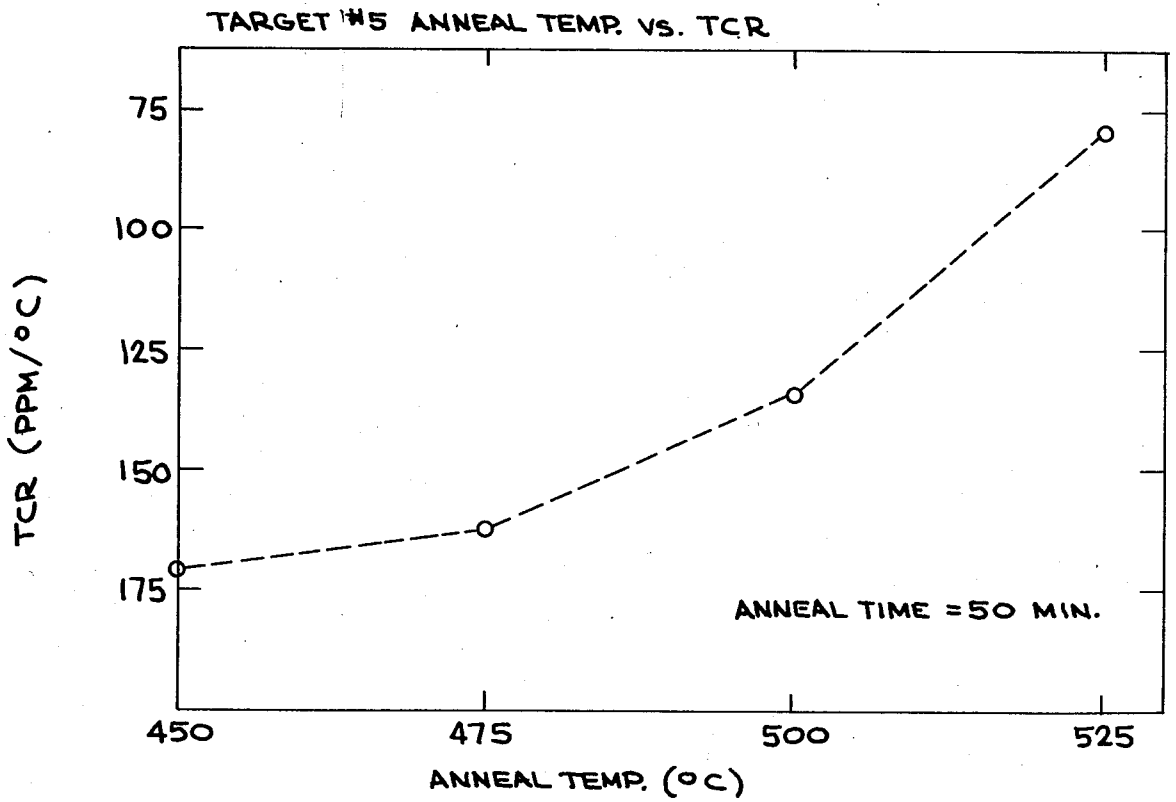
FIG. 6 is a graph plotting anneal time versus TCR.

After the resistor material is applied to the substrate, the material is annealed at a temperature of from about 425° to 475° C., but less than 500° C., for a period of from about 20 to 90 minutes. Preferably, the annealing is carried out at about 450°–460° C. for about 40–60 minutes. As shown in FIGS. 4A and 4B, longer anneal times beyond about 60 minutes do not seem to result in any further change in the resistivity of the material. Higher annealing temperatures improve the temperature coefficient of resistance (TCR) of this particular material as illustrated in FIG. 6. Therefore, it is preferable to anneal at the highest possible temperature which will not be detrimental to other materials such as aluminum which may be already present on the integrated circuit structure.

After applying and annealing the resistor film, the film may be masked and etched to define the desired resistor patterns. The resistor film may be patterned using dry etching techniques. A TiW mask may be applied over the resistor film as a 600–2400 Angstrom film which is then patterned. The exposed portions of the resistor film may then be removed, for example, by dry etching with an Argon bombardment.

To illustrate the practice of the invention, a chromium-silicon-carbon film containing 31 wt. % chromium, 46 wt. % silicon, and 23 wt. % carbon was sputtered onto 4" diameter wafers having, respectively, a CVD silicon oxide substrate and a thermal oxide substrate using a Perkin-Elmer 4410 sputtering machine with a target bias of 1200 volts and the substrates at 0 volts and using a pressure of about $2.0\times10^{-7}$ Torr. The substrates were placed about 20 cm. from the target and the sputtering was carried out until a thickness of about 100 Angstroms was reached. The substrates were then annealed for 50 minutes at 450° C.

Figure 9A:
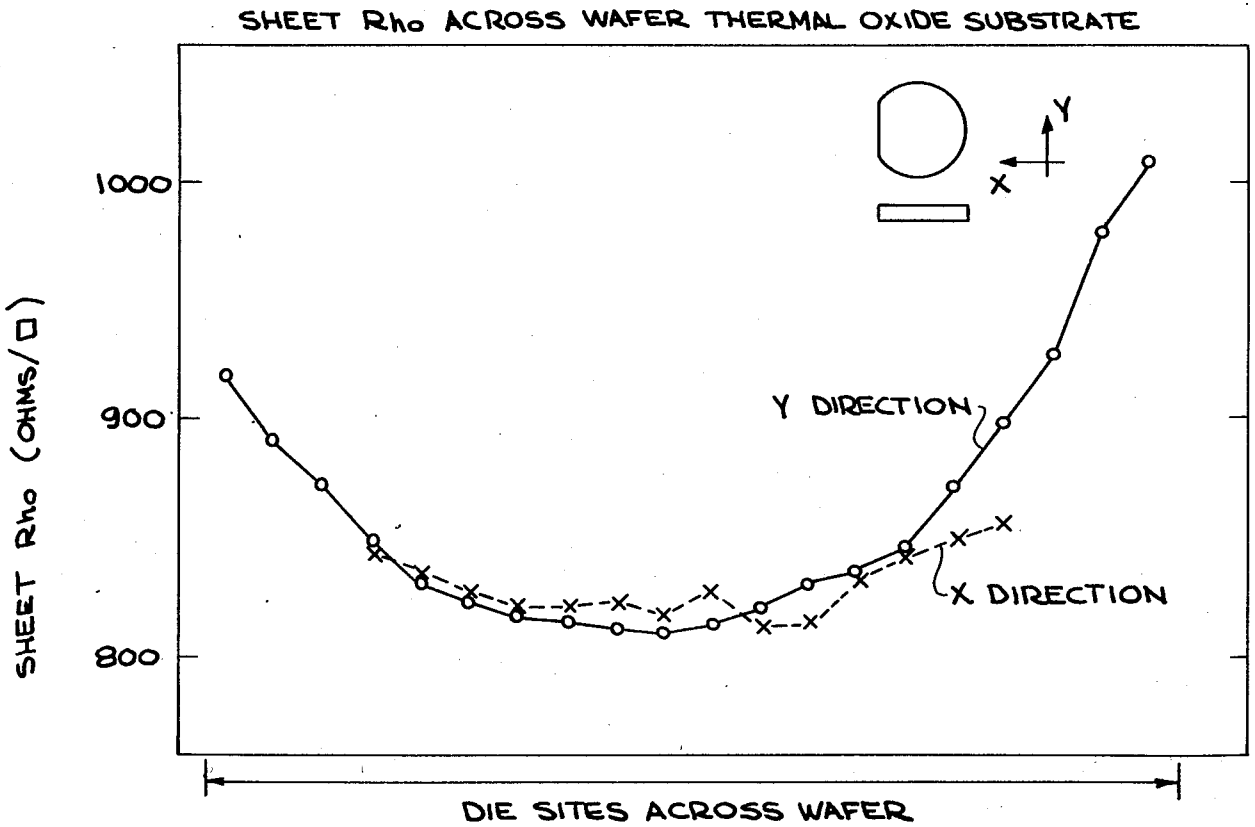
FIGS. 9A and 9B are graphs showing the uniformity of the resistivity across a wafer for two types of substrate material.
Figure 9B:
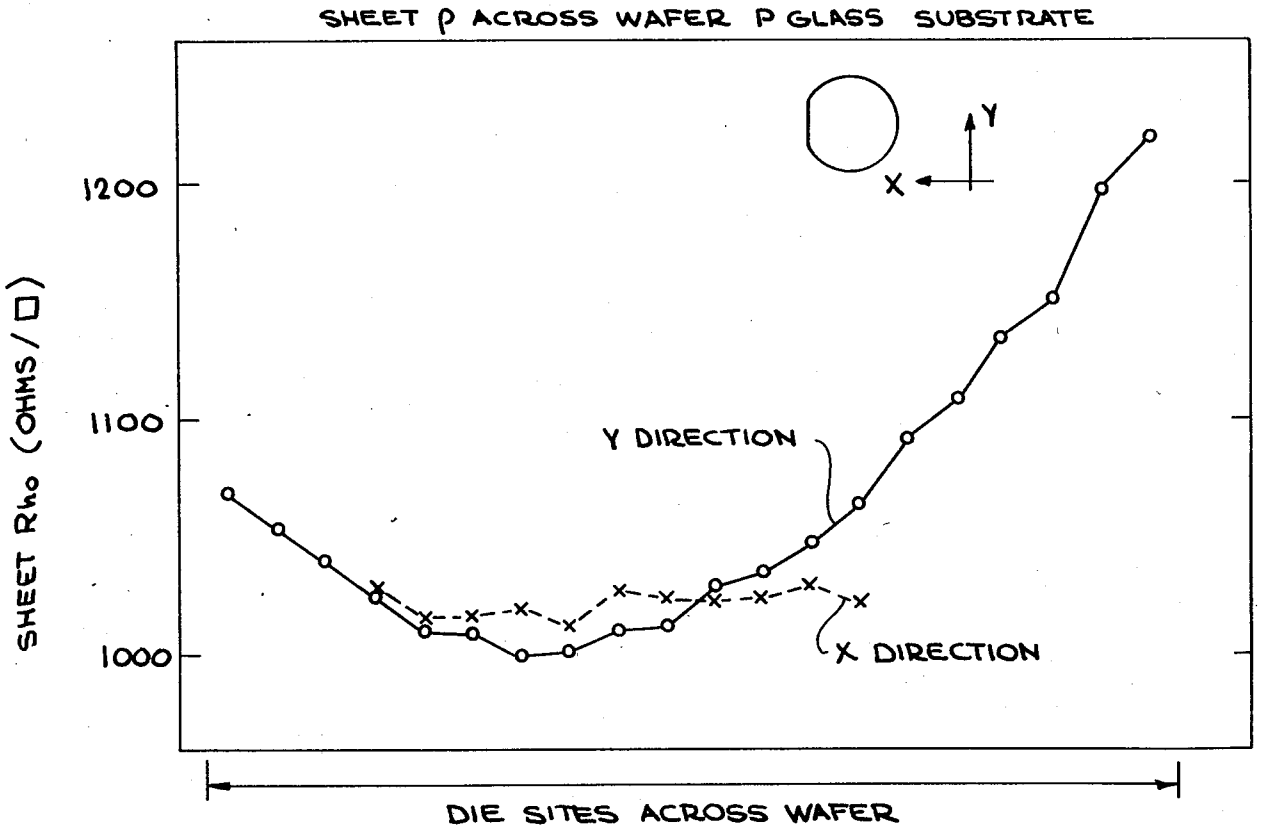

The resistivity of the respective annealed films were then measured using a standard 4-point probe and found to be an average of about 850 ohms per square on the thermal oxide surface and about 1050 ohms per square on the CVD surface. The uniformity of the resistivity across the surface of the wafer for each of the substrates is shown, respectively, in FIGS. 9A and 9B.

Figure 1:
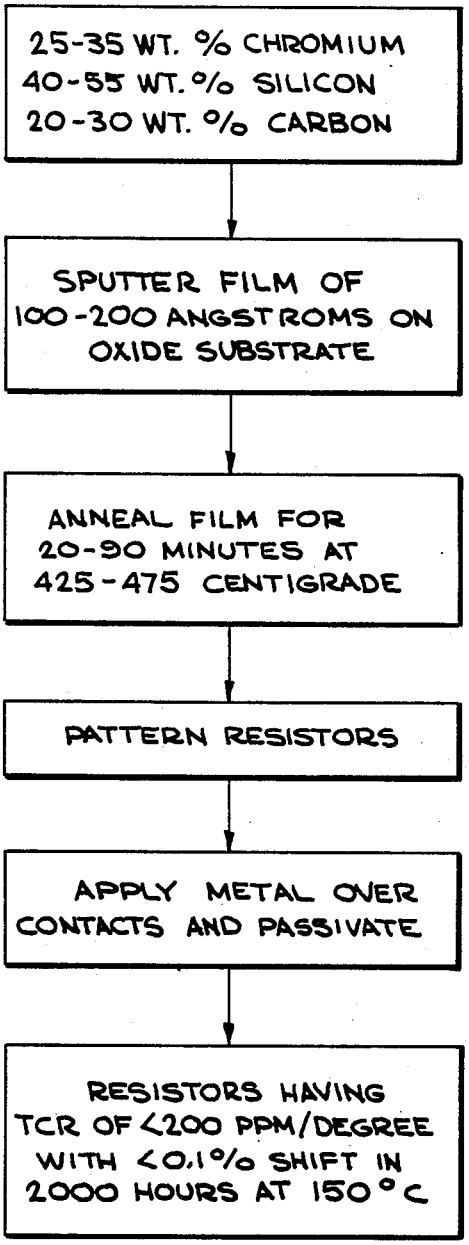
FIG. 1 is a flow sheet illustrating the invention.
Figure 2:
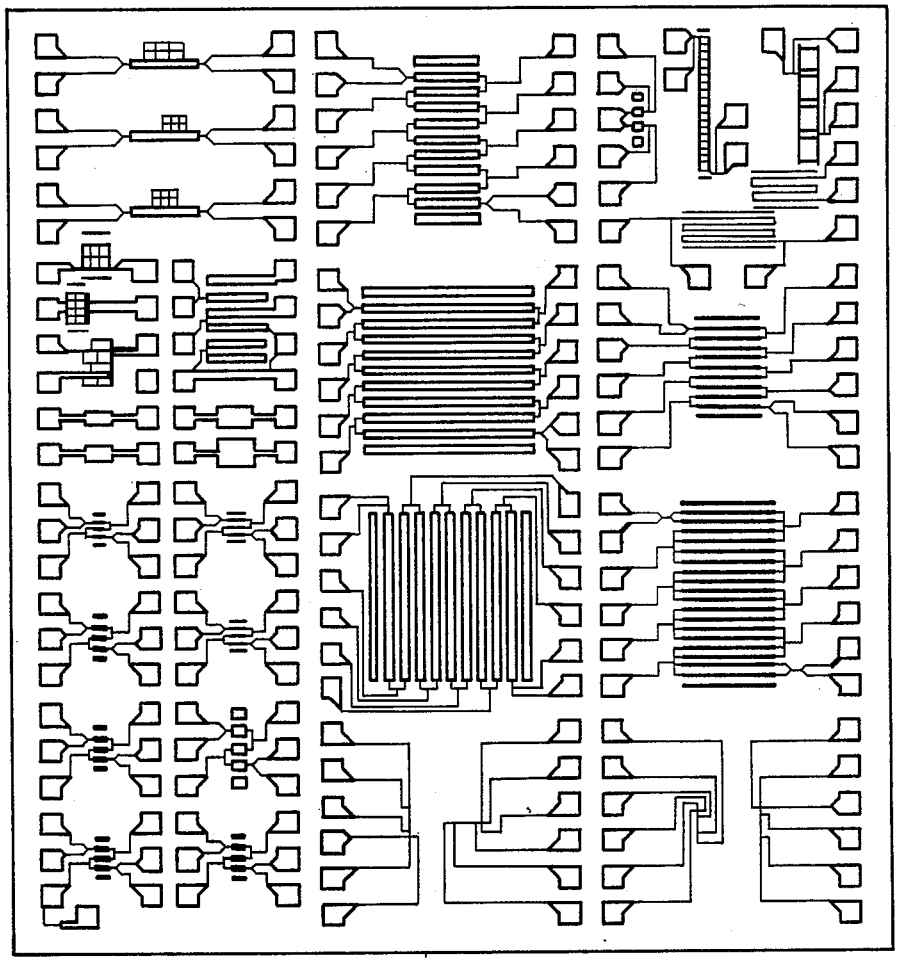
FIG. 2 is a top view of the resistor patterns used to test the characteristics of the resistor material.

The film was then masked with a TiW mask which is wet etched with $H_2O_2$ at room temperature for about 15 minutes. The exposed portions of the resistor film were then dry etched by an Argon bombardment to define a number of resistor patterns as shown in FIG. 2. An aluminum layer was then applied and patterned to cover only the contacts. Two layers of CVD glass of respectively 7500 and 2500 Angstroms were then applied to passivate the resistor surfaces. The resistors were then tested for TCR, assembly shift, uniformity, matching, and lifetime stability.

Figure 5A:
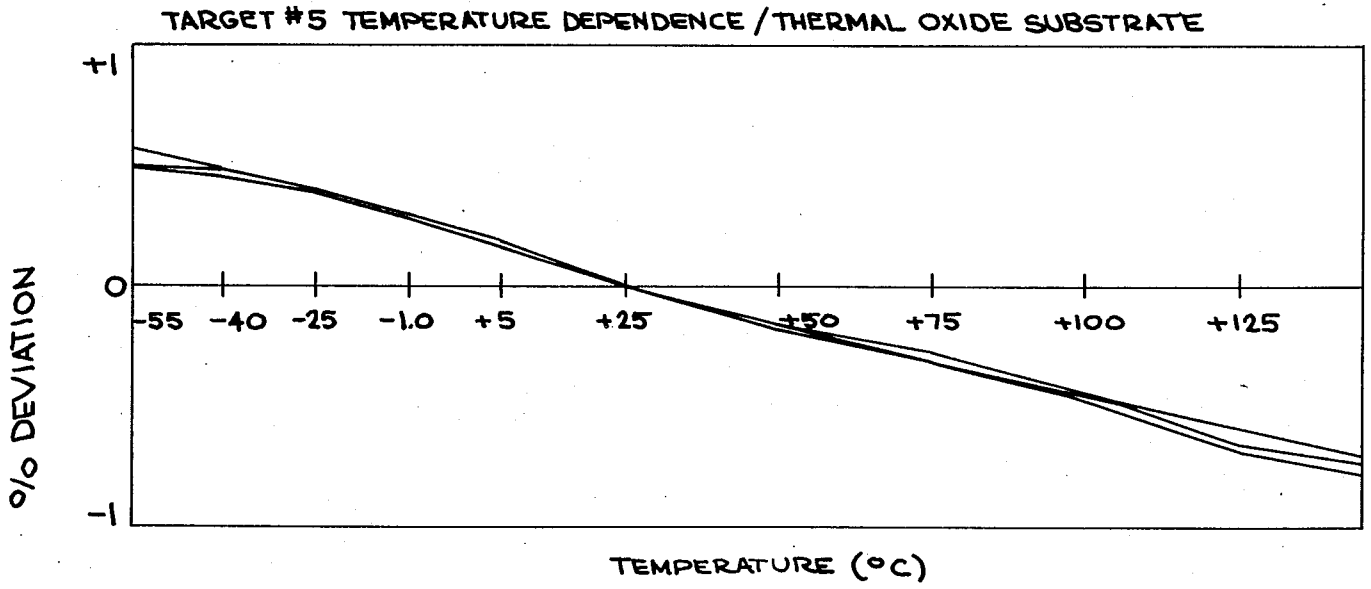
FIGS. 5A and 5B are graphs plotting the TCR of the resistor material from −55° to 145° C. for two different substrates.
Figure 5B:
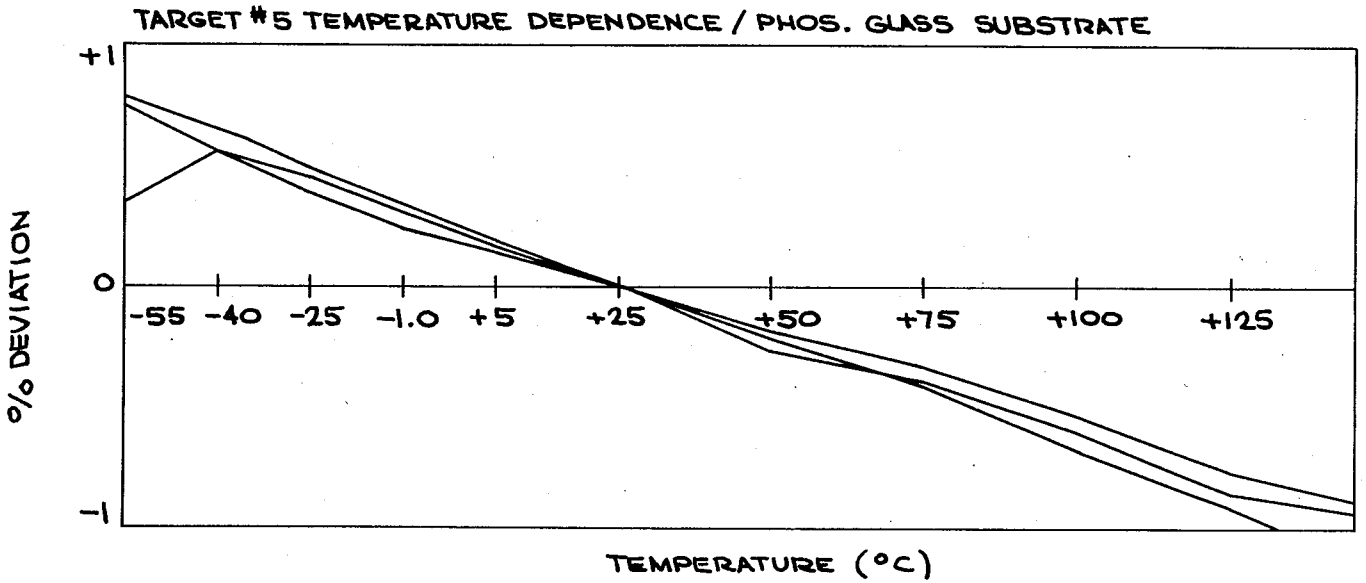

The resistor films were found to have respective resistivities (prior to annealing) of about 800 ohms per square for the thermal oxide substrate and about 925 ohms per square for the CVD substrate as shown in FIGS. 4A and 4B. TCRs of less than 200 ppm per degree Centigrade were measured as shown in the graphs of FIGS. 5A and 5B.

Figure 7A:
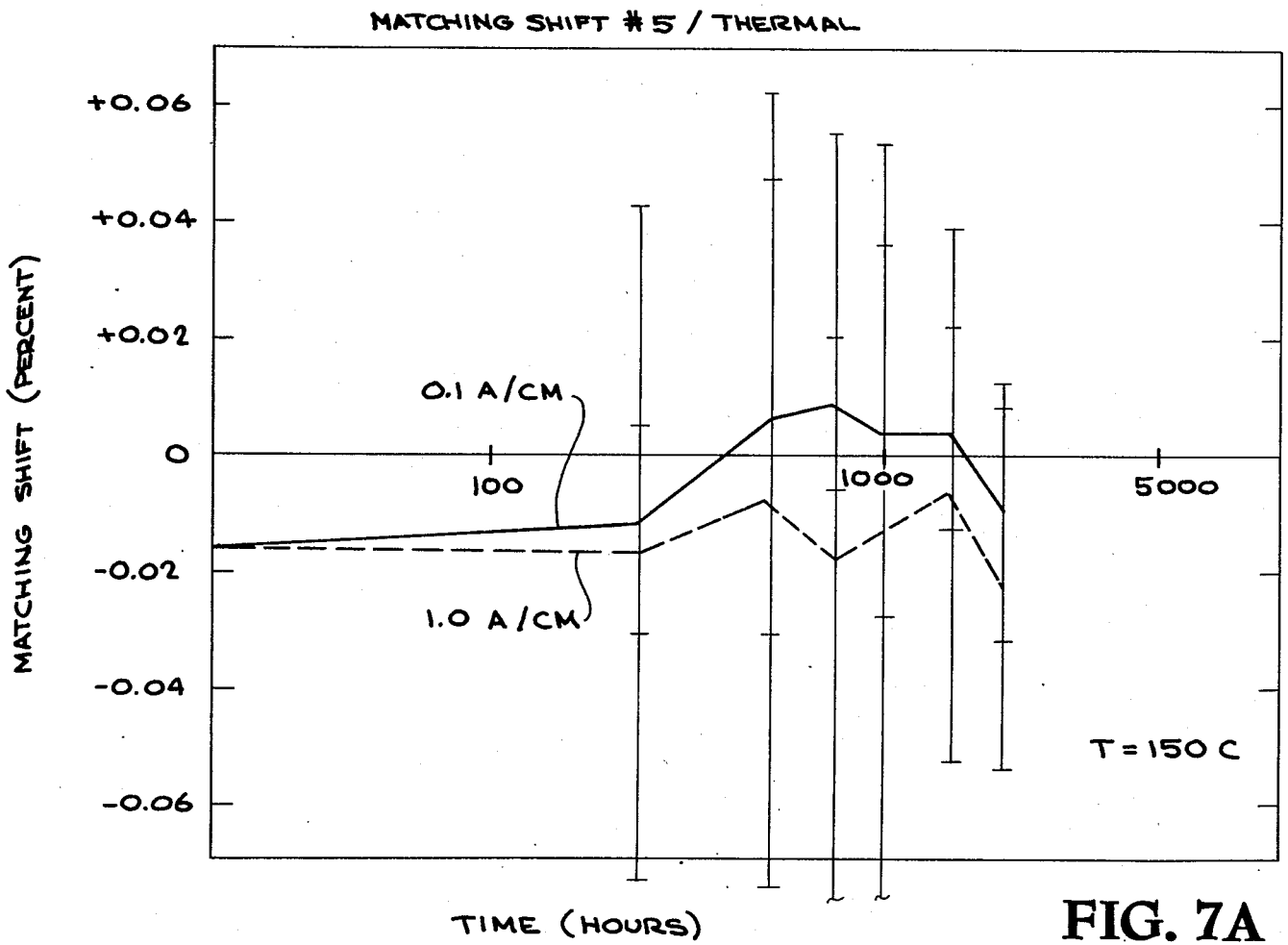
FIGS. 7A and 7B are graphs plotting the matching characteristics of resistors against time on two types of substrates.
Figure 7B:
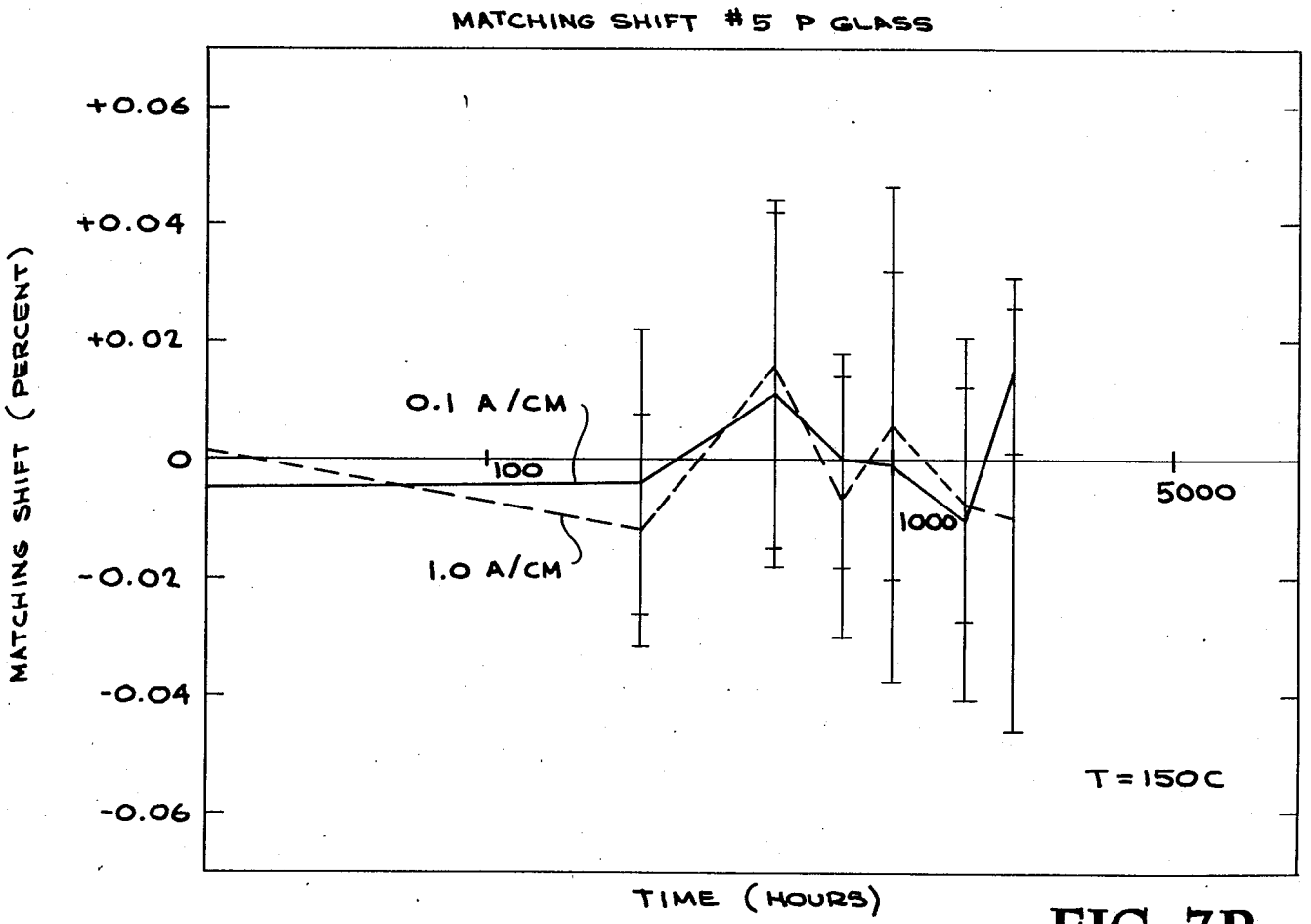
Figure 8A:
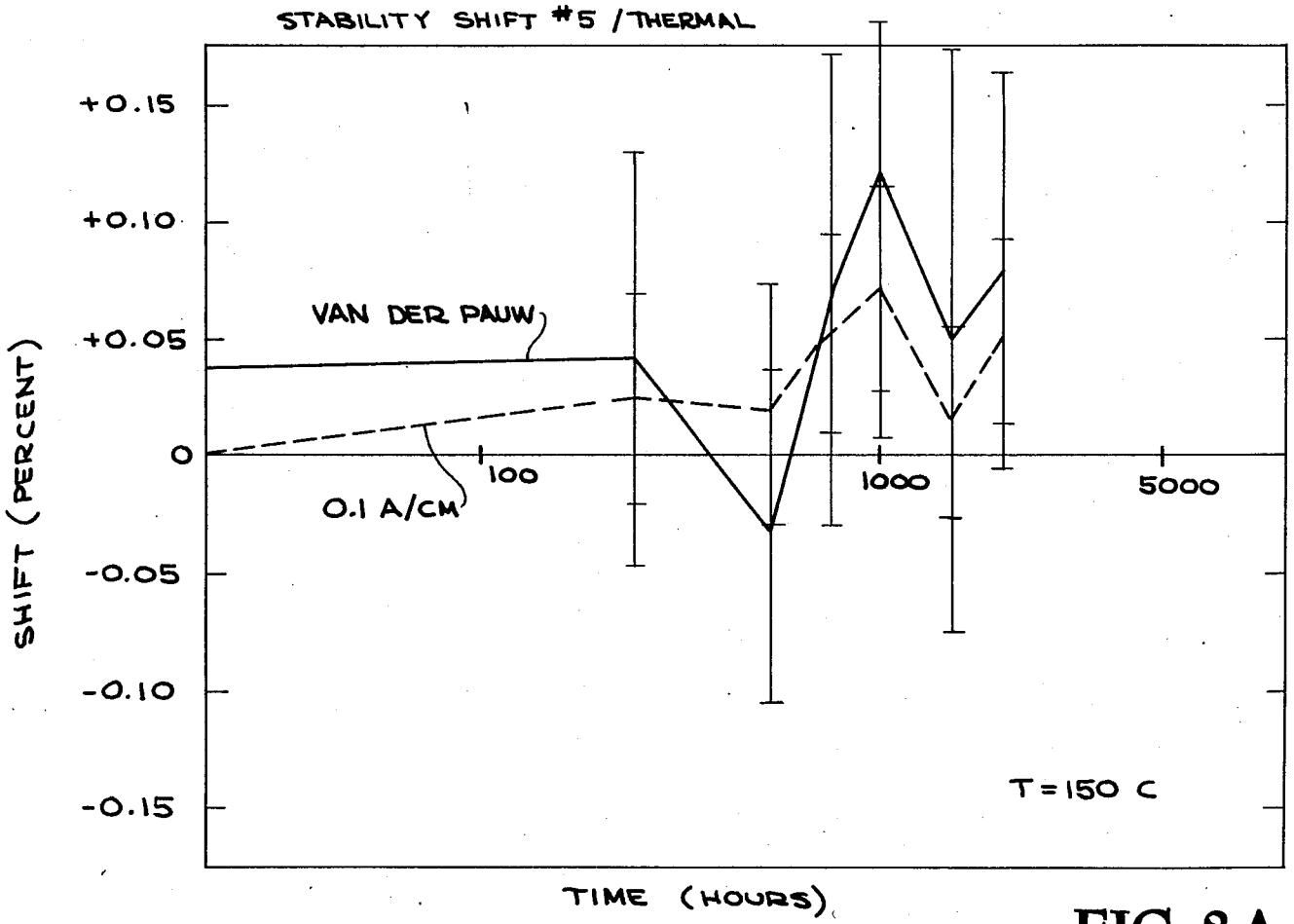
FIGS. 8A and 8B are graphs showing lifetime stability of the resistors on two different substrates.
Figure 8B:
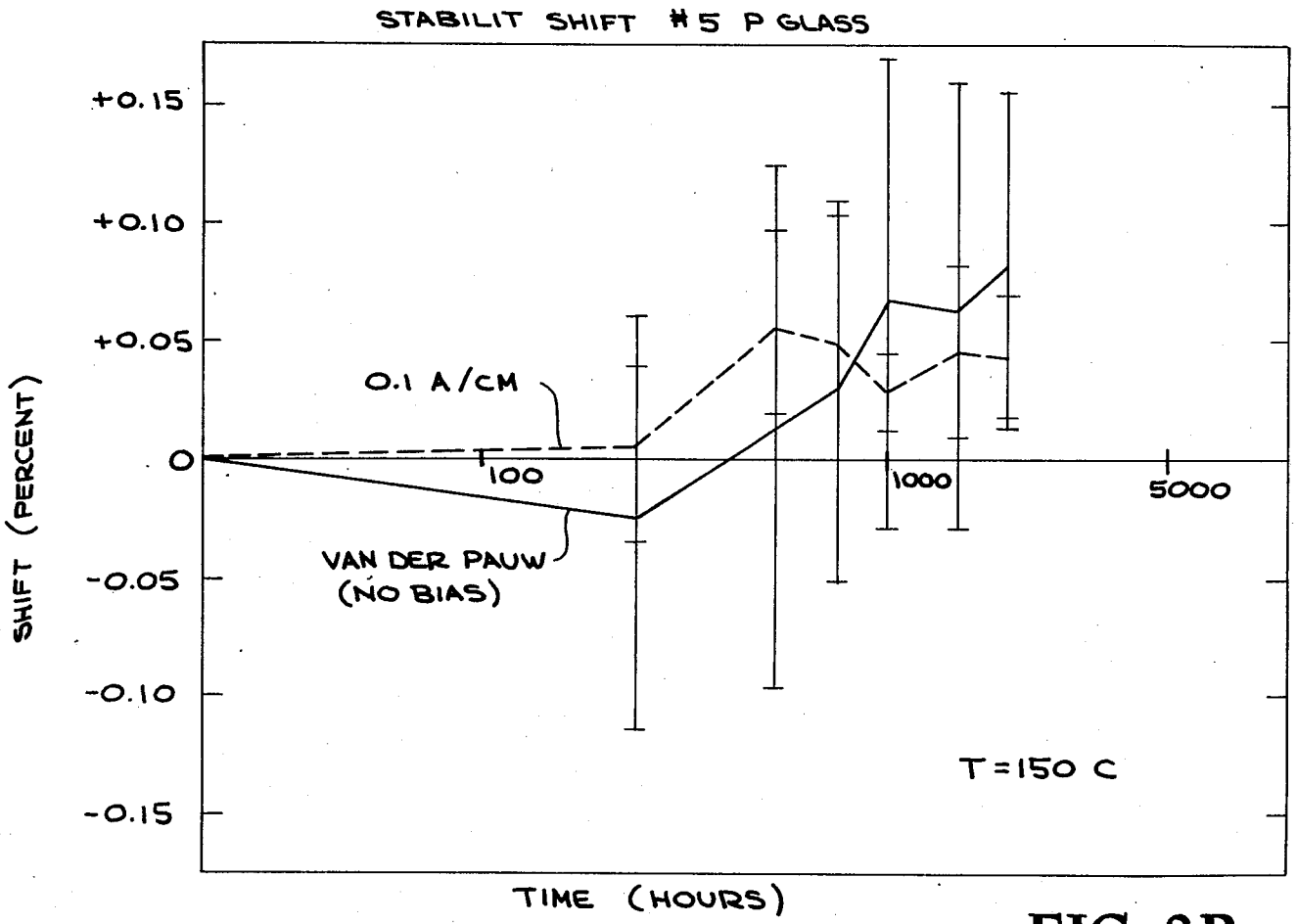

A number of resistors on both types of substrates were tested under current flows of 1.0 and 0.1 amps/cm and using a van Der Pauw test for over 2000 hours at a temperature of 150° C. to simulate lifetime testing. The matching shift results between similar resistors were plotted by dividing the standard deviation by the mean and multiplying by 100%. These are shown in the graphs of FIGS. 7A and 7B while FIGS. 8A and 8B show the average lifetime shift in resistivity for the resistors. In both instances, the results are excellent. Furthermore, the results indicated, when compared to the initial resistivity measurements, that very little assembly shift had occurred during processing of the films prior to the lifetime tests.

Thus, the invention provides an excellent resistor film having low TCR properties, excellent lifetime stability, good matching shift characteristics, reasonably matching thermal coefficients of expansion with CVD and thermal oxide substrates, a resistivity in a range where uniformity can be maintained despite minor variations in film thickness, and low shifting of characteristics when exposed to subsequent assembly processing.

Having thus described the invention, what is claimed is:

1. An improved thin film chromium-silicon-carbon resistor material comprising from about 25 to 35 wt. % chromium, about 40 to 55 wt. % silicon, and about 20 to 30 wt. % carbon and characterized by a resistivity of from greater than about 800 ohms per square to less than about 1200 ohms per square, a temperature coefficient of resistance of less than 200 ppm per degree Centigrade, and lifetime absolute and matching stability of less than 0.1% change in resistivity.

2. The thin film resistor material of claim 1 wherein the chromium content comprises from about 27 to 33 wt. %, the silicon content comprises from about 44 to 50 wt. %, and the carbon content comprises from about 21 to 26 wt. %.

3. The thin film resistor material of claim 2 wherein the chromium content comprises from about 28 to 31 wt. %, the silicon content comprises from about 46 to 48 wt. %, and the carbon content comprises from about 23 to 24 wt. %.

4. The thin film resistor material of claim 3 wherein said material comprises 31 wt. % chromium, 46 wt. % silicon, and 23 wt. % carbon.

5. The thin film resistor material of claim 1 wherein the material is further characterized by a temperature coefficient of expansion substantially matching silicon dioxide.

6. The thin film resistor material of claim 1 further characterized by an annealability at temperatures below 500° C. to avoid damage to any aluminum which may be already present in an integrated circuit structure to which said resistor material is applied.

7. The thin film resistor material of claim 6 which is further characterized by a resistance value which does not substantially change during subsequent processing at temperatures below the annealing temperature.

8. The thin film resistor material of claim 1 which is further characterized as a material which may be applied to a substrate by sputtering at a gas pressure of $2.0\times10^{-7}$ Torr and at a voltage range of from 1000 to 1400 volts.

9. The thin film resistor material of claim 1 which is further characterized by a uniformity of film resistance on a substrate of less than about 14% difference in resistivity.

10. An improved integrated circuit structure comprising a silicon oxide material having formed thereon one or more improved thin film chromium-silicon-carbon resistors comprising from about 25 to 35 wt. % chromium, about 40 to 55 wt. % silicon and about 20 to 30 wt. % carbon which is applicable to said structure by sputtering at a gas pressure of $2.0\times10^{-7}$ Torr or less and at a voltage range of from 1000–1400 volts and which is annealable at a temperature of less than 500° C. to provide a resistance film which will not substantially change in resistance value during subsequent exposure during processing to temperatures lower than the annealing temperature;, said resistor film being further characterized by a resistivity of from greater than about 800 ohms per square to less than about 1200 ohms per square, a uniformity across the resistor film of not more than 14% difference in resistivity, a temperature coefficient of resistance of less than 200 ppm per degree Centigrade, and lifetime absolute and matching stability of less than 0.1% change in resistivity and a temperature coefficient of expansion substantially matching that of the underlying silicon oxide.

11. A method of making an improved resistor for an integrated circuit structure which comprises:

(a) applying to said structure a thin film of a chromium-silicon-carbon resistor material comprising from about 25 to 35 wt. % chromium, about 40 to 55 wt. % silicon, and about 20 to 30 wt. % carbon;

(b) applying a mask over said film;

(c) patterning said mask; and (d) etching exposed portions of said resistor film to produce one or more resistors characterized by a resistivity of from greater than about 800 ohms per square to less than about 1200 ohms per square, a temperature coefficient of resistance of less than 200 ppm per degree Centigrade, and lifetime absolute and matching stability of less than 0.1% change in resistivity.

* * * * *